United States Patent [19]

Carter

[11] Patent Number: 4,924,896

[45] Date of Patent: May 15, 1990

[54] COLLAPSIBLE CANOPY STRUCTURE FOR USE IN ASSOCIATION WITH A CHAIR OR OTHER FREE-STANDING DEVICE

[76] Inventor: Mark C. Carter, 210 Payson St., San Dimas, Calif. 91773

[21] Appl. No.: 415,446

[22] Filed: Sep. 28, 1989

Related U.S. Application Data

[63] Continuation of Ser. No. 155,072, Feb. 11, 1988, abandoned.

[51] Int. Cl.[5] ..... A45B 11/00

[52] U.S. Cl. ..... 135/90; 135/96; 135/110; 135/117

[58] Field of Search ..... 135/96, 106, DIG. 2, 135/110, 90, 117; 297/184, DIG. 6

[56] References Cited

U.S. PATENT DOCUMENTS

| | | | |
|---|---|---|---|
| 684,130 | 10/1901 | Taubert . | |
| 1,326,006 | 12/1919 | Sterhardt . | |
| 1,493,915 | 8/1920 | Baker . | |
| 1,602,980 | 10/1926 | Jacque | 135/96 |
| 1,712,836 | 11/1927 | Mills . | |
| 1,728,356 | 9/1925 | Morgan . | |
| 1,853,367 | 4/1931 | Mace . | |
| 3,174,397 | 3/1965 | Sanborn . | |
| 3,199,518 | 8/1965 | Glidewell . | |
| 3,243,230 | 3/1966 | Otto | 135/96 X |
| 3,335,815 | 8/1967 | Oakes . | |
| 3,375,624 | 4/1968 | Milulin . | |
| 3,496,687 | 2/1970 | Greenberg et al. . | |
| 3,526,066 | 9/1970 | Hagar et al. . | |
| 4,112,957 | 9/1978 | Biven | 297/184 X |
| 4,156,433 | 5/1979 | Beaulieu . | |
| 4,170,242 | 10/1979 | Caso | 135/96 X |
| 4,607,656 | 8/1986 | Carter . | |
| 4,728,147 | 3/1988 | Dutton | 297/DIG. 6 |

FOREIGN PATENT DOCUMENTS

| | | | |
|---|---|---|---|
| 2655028 | 6/1978 | Fed. Rep. of Germany | 297/184 |
| 498686 | 9/1954 | Italy | 297/184 |

*Primary Examiner*—David A. Scherbel
*Assistant Examiner*—Caroline D. Dennison
*Attorney, Agent, or Firm*—Seed and Berry

[57] ABSTRACT

A collapsible canopy for use with a chair or other free-standing device is described. The collapsible canopy of the present invention includes three hoop sections which are covered with material capable of blocking substantial amounts of sunlight. The respective hoop sections are coupled with a cross-coupled truss structure which extends to support the collapsible canopy over a chair or other freestanding device in an open position, and collapses to store the collapsible canopy in an extremely compact form in a closed position.

11 Claims, 8 Drawing Sheets

COLLAPSIBLE CANOPY STRUCTURE FOR USE IN ASSOCIATION WITH A CHAIR OR OTHER FREE-STANDING DEVICE

CROSS-REFERENCE TO RELATED APPLICATION

This application is a continuation of U.S. application Ser. No. 07/155,072 filed Feb. 11, 1988, now abandoned.

FIELD OF THE INVENTION

This invention relates to the field of outdoor shelters and specifically to a collapsible canopy structure for use with outdoor chairs or tables or the like.

BACKGROUND OF THE INVENTION

Many people enjoy outdoor activities. However, some people, particularly in environments with intense sunlight must avoid some or all exposure to sunlight. Studies have shown that in most people, prolonged exposure to intense sunlight increases the risk of certain types of skin cancer.

Many devices have been developed in the past to provide shade in environments with significant amounts of sunlight. One common device for providing shade is an oversized umbrella which may be anchored to an unstable substrate such as sand. At seaside resorts, portable cabanas are often offered. Each of these devices are large and cumbersome making them unattractive to many potential users.

Another device which has been used in the past is an umbrella which has been configured with a clamp instead of a handle wherein the clamp may be used to attach the umbrella to the back of a chair or table top. While this device is portable, it provides only partial shade and it must be constantly adjusted to be effective. All of the abovementioned shade devices are easily blown away or damaged by high wind.

For the foregoing, no device is known which provides a large shaded area when erected, which is highly stable in windy conditions, and which collapses to a compact size for storage and transportation.

SUMMARY AND OBJECTS OF THE INVENTION

Briefly described, the present invention contemplates a collapsible canopy structure for use in association with a freestanding device such as a table or chair. The present invention includes a plurality of hoop sections which are covered with a material capable of blocking the transmission of substantial portions of sunlight. The plurality of hoop sections are supported by a collapsible frame structure which includes a first plurality of struts having a means for attaching the collapsible frame to the freestanding device. The collapsible frame structure further includes first and second frame members attached to said plurality of struts. The first and second frame members comprise a plurality of cross connected truss members which are pivotally attached to the hoop members. When in a closed position, the collapsible canopy structure folds into a compact size. When the collapsible frame structure is fully extended or in its open position, the hoop sections extend up and over the freestanding device to provide a substantially contiguous area of coverage or shade. The present invention further includes a means of adjusting the position of the collapsible frame structure in the fully extended or open position.

Accordingly, it is an object of the present invention to provide a collapsible canopy structure for attachment to a freestanding device.

It is another object of the present invention to provide a collapsible canopy structure which provides a relatively large coverage area.

It is yet another object of the present invention to provide a collapsible canopy structure which is portable and lightweight.

It is still another object of the present invention to provide a canopy structure which is highly resistant to wind.

BRIEF DESCRIPTION OF THE DRAWING

These and other objects may be fully understood through the description below and the accompanying drawing in which.

DETAILED DESCRIPTION OF THE INVENTION

Figure 1A:
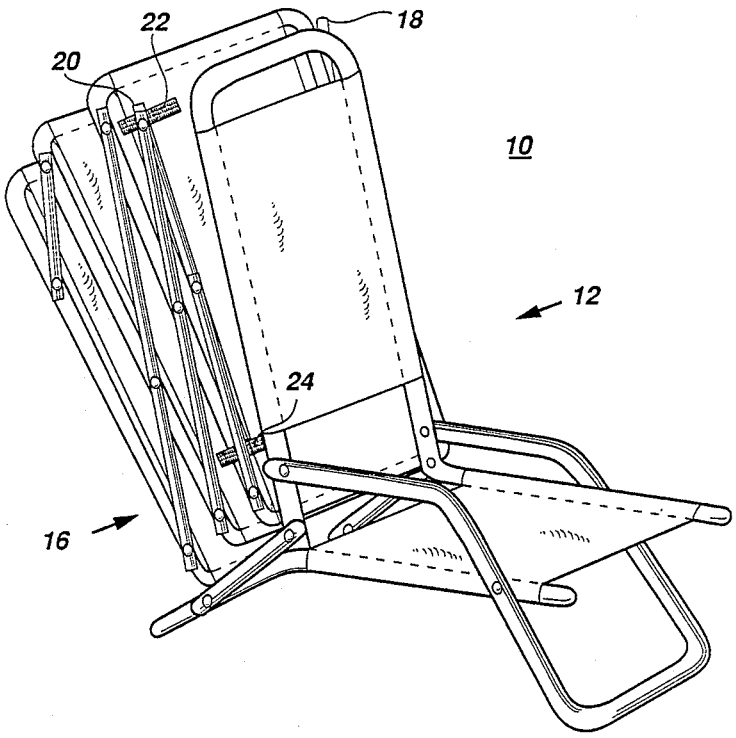
FIG. 1A is a schematic view in perspective of the present invention in a collapsed or closed position.

Referring now to FIG. 1A, the collapsible canopy structure 10 is shown in a substantially closed position. The collapsible canopy structure 10 is particularly adapted for use in association with a freestanding device such as a chair 12. Specifically, the collapsible canopy structure 10 is adapted for attachment to the back 14 of chair 12. The collapsible canopy structure 10 includes collapsible frame structures 16,18 which are substantially identical and symmetrical. Therefore, for the purposes of explanation, only one side of the collapsible frame structure is described herein. Each of the collapsible frame structures includes a strut member 20 adapted for attachment to the back of chair 12. A pair of attachment means 22,24 are disposed opposing ends of each strut 20. The attachment means 22,24 may be any of a number of types of detachable fasteners. In the preferred practice of the present invention, the attachment means 22, 24 suitably comprise hook and loop fasteners such as "VELCRO" which are attached to strut member 20 by means of lock-stitch sewing.

Figure 1B:
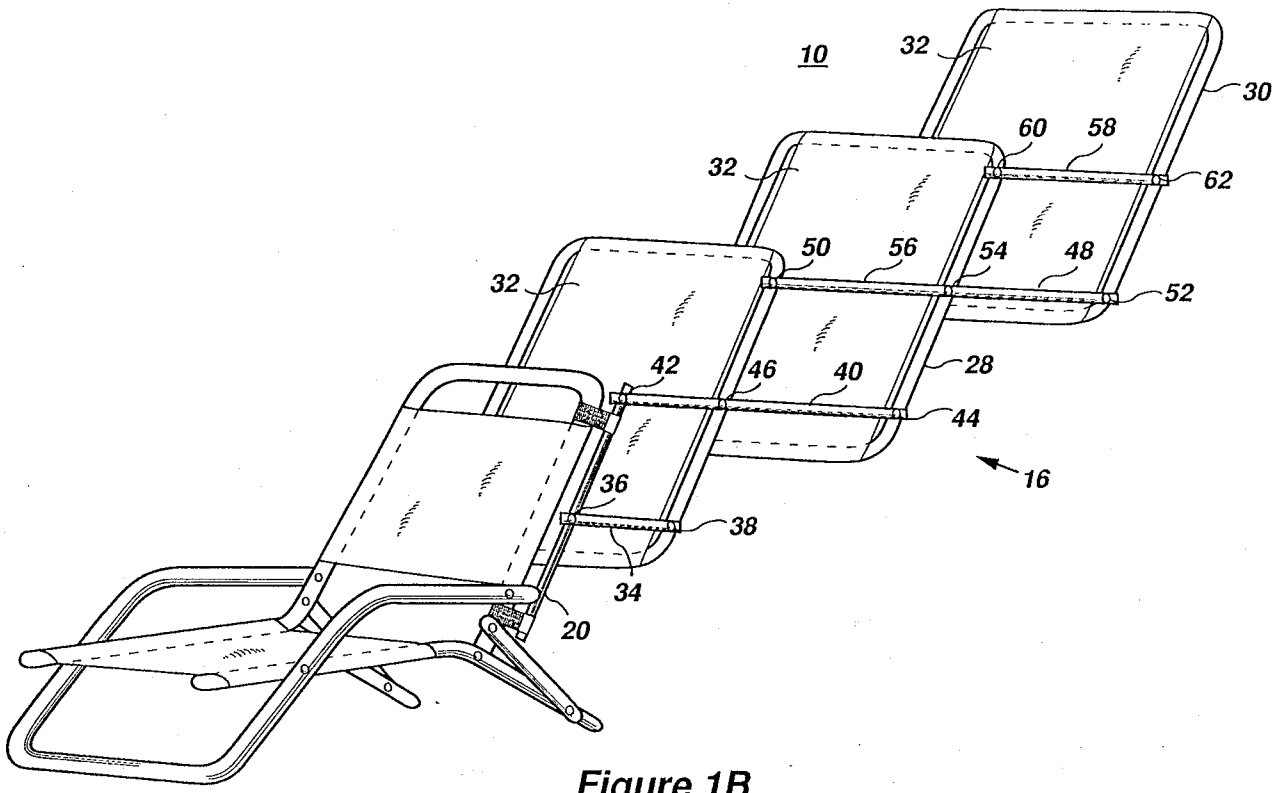
FIG. 1B is a schematic view in perspective of the present invention in a partially extended position.

FIG. 1B shows the collapsible canopy structure 10 in a partially open position. The collapsible canopy structure 10 includes three hoop sections 26,28 and 30 which may be substantially the same size. The hoop members 26,28 and 30 are suitable covered with a fabric material 32 which is capable of blocking the transmission of substantial portions of sunlight. In the preferred practice of the present invention, 400 denier nylon is used for the fabric material 32. As shown in FIG. 1B, the collapsible frame structure 16 is pivotally attached to the strut member 20 and the hoop members 28,30 and 32. Preferably the collapsible frame structure 16, the strut member 20 and the loop members 26, 28 and 30 are constructed of 6061 T5 Spec. cylindrical aluminum tubing with a ⅜" outside diameter and a 0.050" wall thickness. This type of tubing is widely available from manufacturers such as Reynolds Aluminum. Those skilled in the art will appreciate that tubing with rectangular walls may also be used and other materials such as polyvinylchloride plastic, nylon, kevlar, carbon fiber tubing and other materials such as wood may be used to construct these respective members.

In the embodiment shown, the collapsible frame structure 16 includes strut member 20 which is removably attached to the back 14 or chair 12. The collapsible frame structure 16 includes truss member 34 which has one end pivotally attached to the approximate mid-section of strut member 20 at pivot point 36. The other end of strut member 34 is pivotally attached to the lower section of hoop member 26 at pivot point 38. One end of truss member 40 is pivotally attached to the upper section of strut member 20 at pivot point 42. The other end of truss member 36 is pivotally attached to the lower portion of hoop member 28 at pivot point 44. The mid-section of truss member 40 is pivotally attached to the mid-section of hoop member 26 at pivot point 46. One end of truss member 48 is pivotally attached to the upper portion of hoop member 26 at pivot point 50. The other end of truss member 48 is attached to the lower portion of hoop member 30 at pivot point 52. The mid-section of truss member 48 is pivotally attached to the mid-section of hoop member 28 at pivot point 54. As will be discussed in more detail below, pivot point 50 is offset with respect to the end of truss member 48 so that portion 56 of truss member 48 extends beyond pivot point 50. One end of truss member 58 is attached to the upper portion of hoop member 28 at pivot point 60. The other end of truss member is attached to the mid-section of hoop member 30 at pivot point 62. As mentioned above, an identical strut and truss structure 18 is disposed on the opposite side of hoop members 26, 28 and 30 and strut member 20.

Figure 1C:
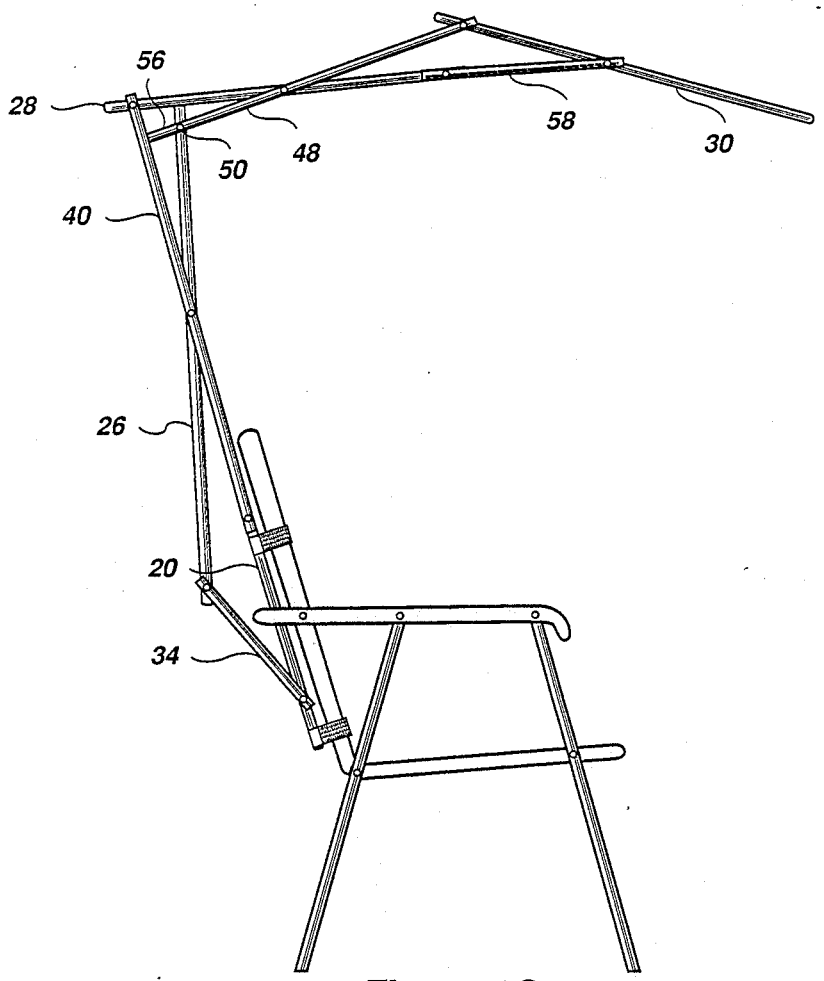
FIG. 1C is a side view of the present invention shown in a fully extended or open position.
Figure 1D:
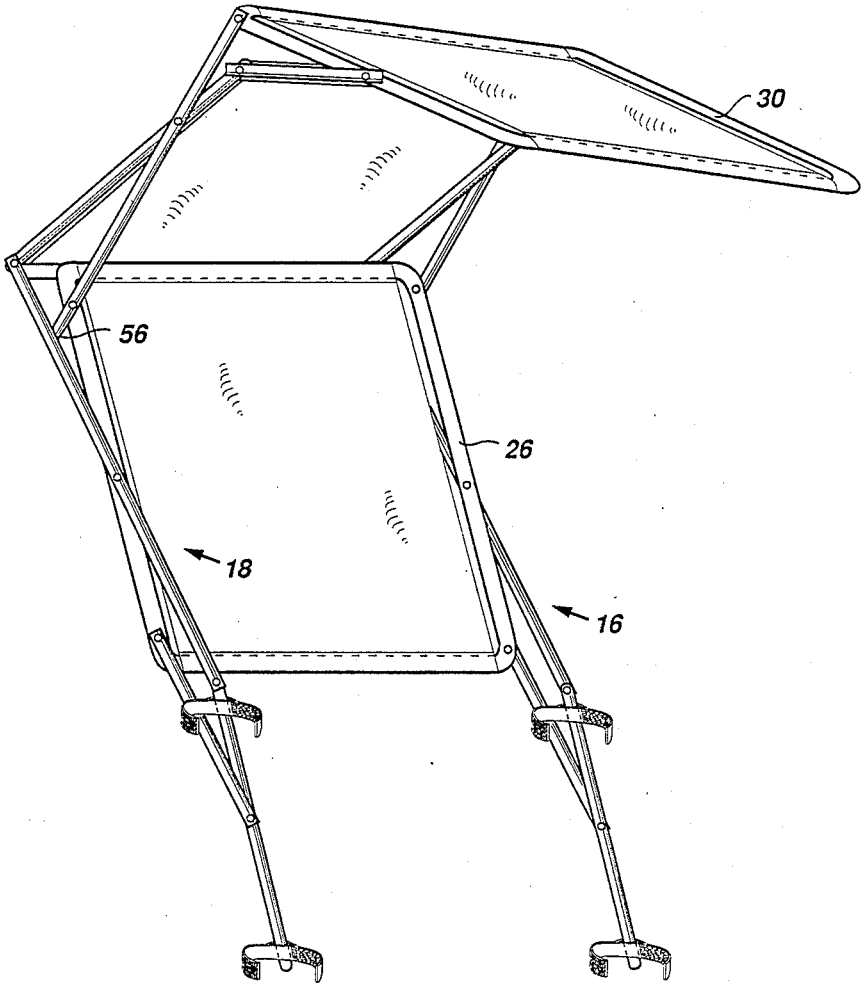
FIG. 1D is a view in perspective of the present invention in a fully extended position shown in free space.

The pivotal attachment of the hoop, strut and truss members allow the collapsible canopy structure 10 to travel between open and closed positions. The stable open position of collapsible canopy structure 10 is shown in FIGS. 1C and 1D. In the open position, the collapsible frame structure 16, 16 support the hoop members 26, 28, 30 in a position which provide a substantially contiguous area of coverage or shade. Specifically, in the open or fully extended position, loop member 26 forms a nearly vertical wall to block sunlight which could strike the back 14 of chair 12 and hoop members 28 and 30 form a top or roof portion of the collapsible canopy structure 10. By virtue of the cross member truss structure formed in the open position, an extremely stable shelter is provided. As mentioned above, the position of pivot point 50 and the length of portion 56 of truss member 48 may be adjusted to vary the ultimate shape of the collapsible canopy in the open position to accommodate a variety of freestanding structures. As shown in FIG. 1C, portion 56 of strut member 48 abuts against strut member 40 in the open position thus locking the frame structure 16, 18 in position. As the length of portion 56 of strut member 48 is varied, the angle of hoop member 30 also varies. As will be further described below, the present invention contemplates the use of a means for varying the length of portion 56 of strut member 48 to allow the present invention to be adapted for use with a wide variety of chairs and other freestanding devices.

FIG. 1D is a view in perspective of the the present invention in the open position wherein portion 56 of strut member 48 may be seen in greater detail. The respective pivot points employed by the present invention are also shown in greater detail. Since the respective strut, truss and hoop sections of the present invention are formed of tubular aluminum, the pivot points may be formed by circular apertures disposed in the respective tubular members with a bolt inserted therethrough. In the preferred practice of the present invention, a 6/32" grade 5 bolt, approximately 1" long may be inserted through the apertures at the respective pivot points. The respective bolts are suitably secured in position with a 6/32" nylon lock nut.

Figure 2:
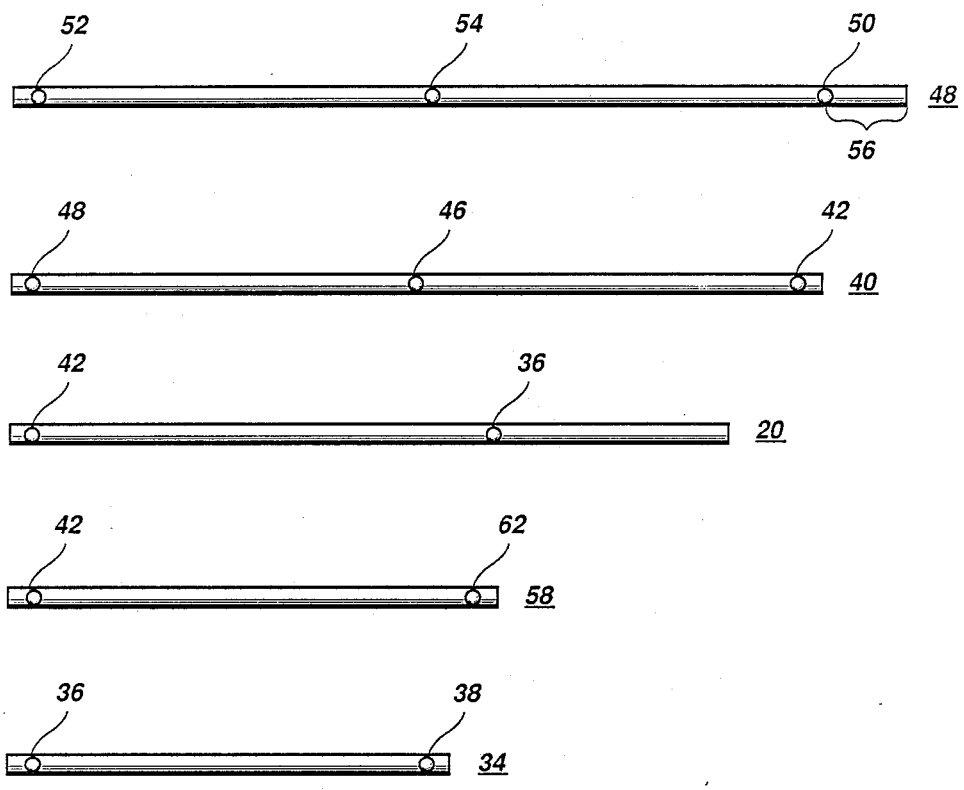
FIG. 2 is a plan view of the various strut and truss members which comprise the collapsible frame structure of the present invention.

Referring now to FIG. 2, the preferred configurations of the respective strut and truss members is shown in detail. While the members shown in FIG. 2 are described with specific dimensions, those skilled in the art will appreciate that a wide range of dimensions may be employed in the practice of the present invention. In the preferred practice of the present invention, strut member 20 is approximately 16" long wherein pivot point 42 is disposed approximately 3/16" from one end of strut member 20 and pivot point 36 is disposed approximately 5 13/16" from the other end of strut member 20.

Truss member 34 is approximately 8⅛" long with pivot points 36 and 38 being disposed approximatey 3/16" from the respective ends of truss member 34. Truss member 58 is approximately 9⅝" long with pivot points 60, 62 being disposed approximately 3/16" from the respective ends of truss member 58. Truss member 40 is approximately 18½" long with pivot points 42, 48 being disposed approximately 3/16" from the respective ends of truss member 40. Pivot point 46 is disposed approximately 8⅛" from the end of truss member 40 which is proximate pivot point 42. Truss member 48 is approximately 19⅝" long with pivot point 52 being disposed approximately 3/16" from one end of truss member 48. Pivot point 50 is disposed approximately 1 5/16" from the other end or truss member 48. Pivot point 54 is disposed approximately 8⅛" from the end of truss member 54 which is proximate pivot point 50.

Figure 3:
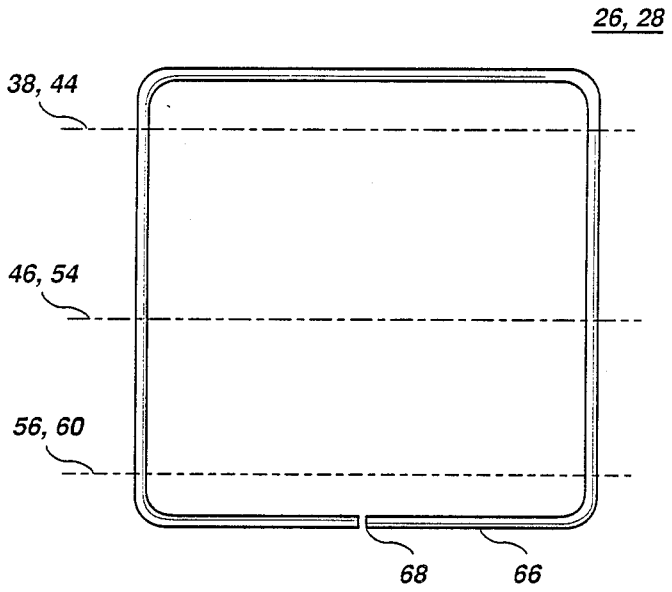
FIG. 3 is a plan view of the first and second hoop members of the present invention.

Referring now to FIG. 3, the configuration of hoop members 26 and 28 is shown in detail. In the preferred practice of the present invention, all of the respective hoop members are substantially the same size. However, in hoop member 30, the respective pivot points are disposed in different locations. Hoop members 26, 28 may be formed of a single piece of tubular aluminum 66 which is formed in a substantially rectangular shape. The respective ends of the single piece of tubular aluminum are joined at split 68. In the preferred practice of the present invention, split 68 may be joined with an interference-fit plastic hoop pin (not shown). The plastic hoop pin may suitably be cylindrical in shape and formed of a material such as polyethylene although other materials may also be suitable. The plastic hoop pin would suitably have a diameter of approximately 0.280" and have a length of approximately 1¼". In the alternative, split 68 may be joined with a process such as welding, taping or glueing. Hoop members 26, 28 are typically formed with a width of approximately 18½" and a height of approximately 21¼". As shown in FIG. 3, hoop members 26, 28 may be formed with rounded corners.

As shown in FIG. 3, pivot points 56, 58 are disposed approximately 1 9/16" from the end of hoop members 26,28 proximate split 68. Pivot points 38,44 are formed approximately 1 9/16" from the other end of hoop members 26,28. Pivot points 46,54 are disposed approximately 8⅛" from pivot points 56,60. For the purpose of clarity, the corresponding opposing pivot points of the respective hoop, truss and strut members bear identical designations.

Figure 4:
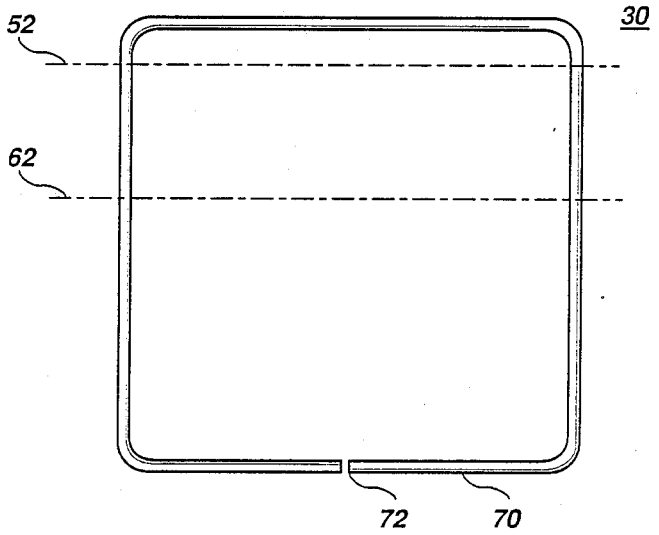
FIG. 4 is a plan view of the third hoop member of the present invention.

Referring now to FIG. 4, the configuration of hoop member 30 may be formed of a single piece of tubular aluminum 70 which is formed in a substantially rectangulr shape. The respective ends of the single piece of tubular aluminum are joined at split 72. In the preferred practice of the present invention, split 72 may be joined with an interference-fit plastic loop pin (not shown) or with any of the other techniques described above. Hoop member 30 is typically formed with a width of approximately 18½" and a height of approximately 21¼". In the preferred practice of the present invention, loop members 30 is formed with rounded corners. As shown in FIG. 4, pivot point 52 is disposed approximately 1 9/16" from the end of hoop member 30 opposite the end proximate split 68. Pivot point 62 is disposed approximately 8⅛" from pivot point 52.

Figure 5:
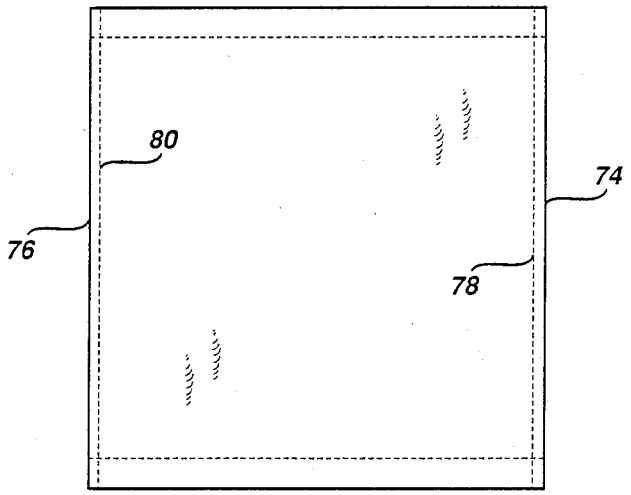
FIG. 5 is a plan view of the fabric covering which is disposed over the respective hoop members of the present invention.

Referring now to FIG. 5, the fabric panel 32 used in association with hoop members 26,28 and 30 is shown in detail. The fabric panel 32 may be formed of any material which is capable of blocking the transmission of substantial portions of sunlight although in some applications, such as a rain shelter, the fabric panel 32 may be replaced by a transparent or waterproof material. In the preferred practice of the present invention, the fabric panel 32 is approximately the same overall dimensions as respective hoop members after it is attached to the respective hoop members. Depending upon the material used and the particular application, it may be desirable to cut the fabric panel 32 slightly oversized and fold the fabric panel along sides 74,76. The folded sides may then be secured with seams 78,80 approximately ¼" for the respective edges of fabric panel 32. In the preferred practice of the present invention, the fabric panel 32 is cut approximately 1" larger on two of opposing sides 82, 84 with respect to the hoop members and these 1" sections are looped over the respective loop members and sewn to secure the fabric panel to the respective hoop members.

Figure 6A:
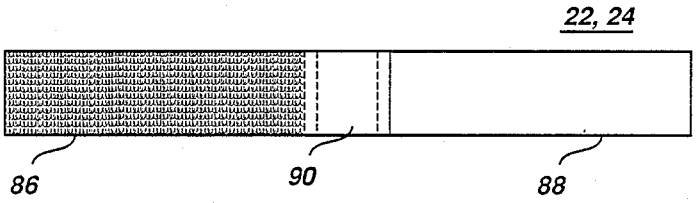
FIG. 6A is a plan view drawing of the hook and loop fastener which is used to attach the collapsible frame structure to the freestanding device.
Figure 6B:
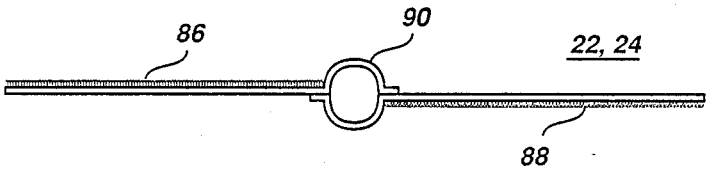
FIG. 6B is a side view drawing of the hook and loop fastener which is used to attach the collapsible frame structure to the freestanding device.

Referring now to FIGS. 6A and 6D the VELCRO attaching means 22,24 are shown in detail. Those skilled in the art will appreciate that the term VELCRO refers to a widely available and well known hook and loop fastening material. The attaching means 22,24 are suitably formed of respective hook and loop sections 86,88 which are approximately 1" wide and 3 15/16" long. The respective hook and loop sections 86,88 are disposed with an overlapping region 90 which engages strut members 20. When the respective sections of attaching means 22,24 placed over strut member 20, the respective sections 86,88 are sewn together by means of a lock-stitch seam.

Figure 7A:
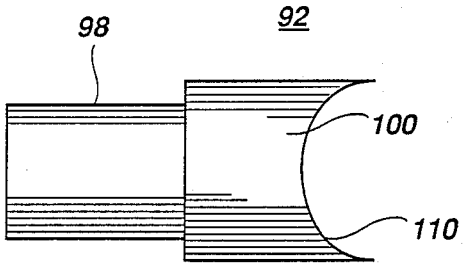
FIGS. 7A–7B are side views of adjustment dowels which are used to adjust the position of the collapsible frame member in the fully extended or open position.
Figure 7B:
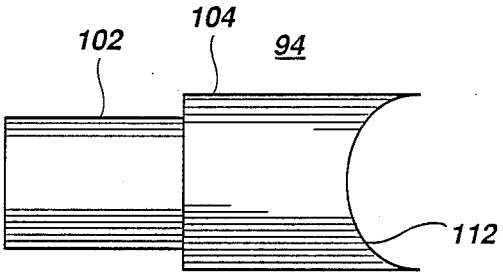
Figure 7C:
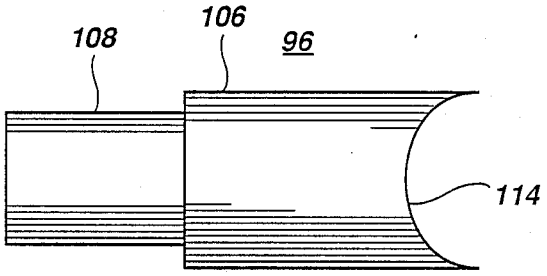

Referring now to FIG. 7 the means for adjusting the length of section 56 of truss member 48 as described above in conjunction with FIGS. 1C and 1D is shown in detail. Since the present invention contemplates the use of hollow truss members, a plurality of adjustment dowels may be used to adapt the present invention for use with many types of free standing structures. By virtue of the length ratio of section 56 with respect to the remaining length of truss member 48 and further with respect to pivot point 50, relative small increments in length of section 56 will have a relatively large effect on the position of hoop member 30. The adjustment dowels 92,94 and 96 may be configured with length increments in the range of approximately ⅛" in the preferred practice of the present invention. Each of the adjustment dowels 94,94 and 96 include a stub portion 98, 102, 108 which may be inserted into the hollow end of truss member 48. The adjustment dowels 92,94 and 96 are further provided with concave surfaces 110, 112 and 114, respectively, which are adapted to rest against truss member 40 when the adjustable canopy structure 10 is in the open position. Therefore, the hoop a desired position of hoop member 30 may be selected by choosing the appropriate adjustment dowel for insertion into the end of truss member 48. As will be appeciated by those skilled in the art, the attractiveness of the present invention may be enhanced by placing cover caps over the remaining open ends of the respective tubular members.

In summary, a collapsible canopy structure for use with a chair or other fastening device has been described. The present collapsible canopy structure is movable between open and closed positions wherein said closed position provides a compact and portable package and said open position provides a highly stable structure which provides a large shaded area. Accordingly, other uses and modifications will be apparent to persons of ordinary skill in the the art and all of such uses and modifications are intended to fall within the scope of the present invention and particularly as defined by the appended claims.

What is claimed is:

1. A collapsible canopy for use in association with a chair or other free-standing structure, comprising:

a plurality of strut means including means for attaching said plurality of strut mean to a chair or other free-standing device;

first, second and third hoop means wherein each of said hoop means are covered with material capable of blocking substantial amounts of sunlight; and collapsible truss means coupled to said strut means and said first, second and third hoop means for supporting said hoop means in open and closed positions, wherein said collapsible truss means comprises a plurality of truss members pivotally attached to said strut means and said hoop means forming a cross-truss with respect to said strut and hoop means, and further wherein said first, second and third hoop means provide an area of coverage over said chair or other free-standing device when said collapsible truss means is in said open position.

2. The apparatus of claim 1 wherein said means for attaching said strut members comprises a hook and loop type fastener.

3. The apparatus of claim 1 wherein said material capable of blocking substantial amounts of sunlight comprises nylon fabric.

4. The apparatus of claim 1 wherein said collapsible truss means hold said hoop means in contact with each other when said collapsible truss means is in said closed position.

5. The apparatus of claim 1 further including means for adjusting the position of said collapsible truss means in said open position.

6. A collapsible canopy for use in association with a chair or other free-standing structure, comprising:

a plurality of strut means including means for attaching said plurality of strut means to a chair or other free standing device;

a plurality of hoop means wherein each of said hoop means are covered with a material capable of blocking substantial amounts of sunlight; and collapsible truss means coupled to said strut means and said hoop means for supporting said hoop means in open and closed positions, wherein said collapsible truss means comprise a plurality of truss members pivotally attached to said strut means and said hoop means forming a cross-truss with respect to said hoop means and further wherein at least one of said truss members butts against another when said collapsible canopy is in said open position, and further wherein said hoop means provide an area of coverage over said chair or other freestanding device when said collapsible truss means is in said open position.

7. A collapsible canopy structure having opened and closed positions for use in association with a chair or other free-standing device, comprising:

a pair of strut means including means for attaching said plurality of strut means to a chair or other free-standing device;

first, second and third hoop means wherein each of said hoop means are covered with material capable of blocking substantial amounts of sunlight;

a first pair of truss supports pivotally attached between aid pair of strut means and said first hoop means;

a second pair of truss supports pivotally attached to said pair of strut means and said first and second hoop means;

a third pair of truss supports pivotally attached to said first, second and third hoop means wherein each member of said third pair of truss supports each include a portion which extends beyond the pivotal attachment of said second hoop means and said third pair of truss supports wherein said portion which extends butts against said second pair of truss supports when said canopy is in said open position; and a fourth pair of truss supports pivotally coupled between said second and third hoop means.

8. The apparatus of claim 7 wherein said means for attaching said struct members comprises a hook and loop type fastener.

9. The apparatus of claim 7 wherein said material capable of blocking substantial amounts of sunlight comprises nylon fabric.

10. The apparatus of claim 7 wherein said collapsible truss means hold said hoop means in contact with each other when said collapsible truss means is in said closed position.

11. The apparatus of claim 7 further including means for adjusting the position of said collapsible truss means in said open position.

* * * * *

UNITED STATES PATENT AND TRADEMARK OFFICE

CERTIFICATE OF CORRECTION

PATENT NO. : 4,924,896

DATED : May 15, 1990

INVENTOR(S) : Mark C. Carter

It is certified that error appears in the above-identified patent and that said Letters Patent is hereby corrected as shown below:

In claim 7, column 8, line 8, delete "aid" and substitute therefor --said--.

Signed and Sealed this

Twenty-ninth Day of October, 1991

*Attest:*

HARRY F. MANBECK, JR.

*Attesting Officer*

*Commissioner of Patents and Trademarks*